US005397087A

United States Patent [19]

Teece

[11] Patent Number: 5,397,087

[45] Date of Patent: Mar. 14, 1995

[54] UNIVERSAL MOUNT FOR SHELVING SYSTEM

[75] Inventor: Dennis L. Teece, Brea, Calif.

[73] Assignee: J D Store Equipment, Inc., Los Angeles, Calif.

[21] Appl. No.: 932,076

[22] Filed: Aug. 19, 1992

[51] Int. Cl.[6] ..... A47B 926/00

[52] U.S. Cl. ..... 248/270.2; 211/106; 248/221.1; 248/221.3

[58] Field of Search ..... 248/220.3, 221.1, 221.2, 248/221.3, 223.3, 220.2; 211/87, 94, 106

[56] References Cited

U.S. PATENT DOCUMENTS

| | | | |
|---|---|---|---|
| 2,790,616 | 4/1957 | Cardinal, Jr. | 248/223.3 |
| 2,872,145 | 2/1959 | Goldsholl | 248/221.1 |
| 3,037,733 | 6/1962 | Roman | 248/222.3 |
| 3,595,,404 | 7/1971 | Goldstein . | |
| 3,896,718 | 7/1975 | Giambalvo . | |
| 3,921,948 | 11/1975 | Long . | |
| 4,248,352 | 2/1981 | White . | |
| 4,340,144 | 7/1982 | Cousins | 211/106 |
| 4,591,058 | 5/1986 | Amstutz et al. . | |
| 4,629,076 | 12/1986 | Amstutz et al. . | |
| 4,722,147 | 2/1988 | Gieske et al. . | |
| 4,805,784 | 2/1989 | Solheim et al. . | |
| 4,809,479 | 3/1989 | Tierno et al. . | |
| 4,842,230 | 6/1989 | Cobb et al. | 211/106 |
| 4,961,295 | 10/1990 | Kosch, Sr. et al. . | |
| 4,971,206 | 11/1990 | Lemmerman et al. . | |
| 5,014,949 | 5/1991 | Niven . | |
| 5,137,239 | 8/1992 | Horton | 248/221.2 |
| 5,165,640 | 11/1992 | Williams, 3rd | 248/221.2 |

FOREIGN PATENT DOCUMENTS

| | | | |
|---|---|---|---|
| 1112390 | 8/1961 | Germany | 248/221.1 |
| 2715396 | 10/1978 | Germany | 248/220.3 |
| 6606178 | 11/1966 | Netherlands | 211/106 |
| 705578 | 3/1954 | United Kingdom | 248/221.2 |

OTHER PUBLICATIONS

JD Store Equipment, Inc., 800 series price list; "JD's 8000 Series Entertainment Software Modular Merchandising System," 1990.

JD Store Equipment, Inc., Brochure; "JD'S Modular Counter System," 1991.

JD Store Equipment, Inc., Advertising Brochure; "Big John'S Illuminated Theater Poster Holder," 1991.

JD Store Equipment Inc., "Video Outlet" Advertising Brochure, 1991.

*Primary Examiner*—Kenneth E. Peterson

*Attorney, Agent, or Firm*—Knobbe, Martens, Olson & Bear

[57] ABSTRACT

A universal mounting hook attaches to a variety of industrial and commercial adjustable shelving systems to provide interchangeability between the shelving systems. The universal mounting hook comprises a generally vertical leg and a generally horizontal leg. The vertical leg includes an "L"-shaped hook positioned at the top of the vertical leg and an abutting portion positioned at the base of the vertical leg. The abutting portion protrudes from the general line of extension of the vertical leg, in a direction opposite from the horizontal leg. The base of the abutting portion connects to an inverted "L"-shaped indentation which interconnects the vertical leg and the horizontal leg. A spring clip extends from the horizontal leg adjacent the indentation so that the spring clip and the indentation form an enclosure which receives a supporting wire. The entire mounting hook may be securely fastened to one of a plurality of different shelving systems so as to support shelving or merchandise baskets.

16 Claims, 7 Drawing Sheets

UNIVERSAL MOUNT FOR SHELVING SYSTEM

BACKGROUND OF THE INVENTION

1. Field of the Invention

The present invention relates to shelving systems, and more particularly to adjustable, modular shelving systems.

2. Brief Description of Related Art

Retail stores, such as, for example, convenience stores, music stores, supermarkets, department stores, video rental stores, electronic stores, and the like, commonly use adjustable modular shelving systems to display merchandise. Industry also uses such adjustable shelving systems for storage. Presently, the majority of such shelving systems comprise either slatwall, pegboard, or gridwall shelving systems, and such retail stores often use two or more of these shelving systems.

Slatwall shelving systems typically comprise a wallboard having a plurality of horizontal grooves which extend along the length of the wallboard. These grooves generally have an "L"-shape in cross section with the vertical leg extending parallel to and inside of the wallboard, and cooperate with mounting hooks or brackets which support shelves, baskets, display units and the like. The grooves may alternatively have a "T"-shape in cross-section with the upper leg of the "T"-shape extending parallel to and inside of the wallboard. For examples of slatwall shelving systems, see Amstutz, et al., U.S. Pat. No. 4,591,058; Amstutz, et al. U. S. Pat. No. 4,629,076; Gieske, et al., U.S. Pat. No. 4,722,147; Solheim, U.S. Pat. No. 4,805,784; Tierno, et al., U.S. Pat. No. 4,809,479; and Kosch, et al., U.S. Pat. No. 4,961,245.

The mounting hooks commonly have a generally vertical leg, a portion of which abuts the wallboard, and a generally horizontal leg which extends outward from the wallboard. At the top of the vertical leg, a small "L"-shaped hook is typically formed. The "L"-shaped hook is inserted into a groove to hang the mounting hook against the wall and to support the combined weight of the shelf and merchandise.

Pegboard shelving systems are also common in the shelving industry. Pegboard systems usually comprise a rigid wall panel having a plurality of round or square holes typically arranged in horizontal rows and vertical columns. Mounting hooks similar to those employed in slatwall systems may also be used with pegboard shelving systems. The "L"-shaped hook at the top of the mounting hook vertical leg is inserted into a peg hole to secure the mounting hook against the panel as described above. For examples of pegboard display systems, see Giambalvo, U.S. Pat. No. 3,896,718; Lang, U.S. Pat. No. 3,921,948; and White, U.S. Pat. No. 4,248,352.

Gridwall, another common shelving system, comprises a wire grid panel which forms a supporting structure. The wire grid panel may be mounted against a wall, extended away from a wall to form "finger walls," or configured as a stand-alone floor fixture or island display. The gridwall panel forms a frame onto which shelving may be mounted.

The configuration of the wire grid panel prevents the use of the mounting hooks conventionally used with slatwall and pegboard shelving systems with the gridwall system. Instead, a differently configured mounting hook is typically employed with gridwall shelving systems.

The mounting hooks of the gridwall systems generally include a vertical leg and a horizontal leg similar to those of the mounting hooks used in the slatwall and pegboard shelving systems. However, the mounting hooks of the gridwall system typically have an inverted "U"-shaped catch formed at the top of the vertical leg, in lieu of the "L"-shaped hook of the slatwall and pegboard mounting hooks. The catch hangs on a horizontal wire of the grid to secure the mounting hook onto the gridwall panel. The vertical leg of the mounting hook has an abutting portion, similar to the slatwall and pegboard mounting hook, which rests against the gridwall panel with the horizontal leg extending outward from the gridwall panel and supporting a shelf or basket.

Certain disadvantages are associated with these prior mounting hooks. Most notably, these hooks do not universally attach to the three aforementioned shelving systems. That is, prior mounting hooks are not interchangeable between the shelving systems. Moreover, the mounting hooks usually are permanently attached (e.g., welded) to the shelves, and, therefore, cannot be interchanged among the shelves. Thus, if a store includes, for example, a gridwall shelving system as an island unit and a slatwall shelving system on the walls, the store must purchase and store shelves and baskets for both types of shelving systems.

SUMMARY OF THE INVENTION

In view of the aforementioned disadvantages associated with conventional mounting hooks for use with adjustable shelving systems, a need exists for a universal mounting hook which may be used with any one of the three conventional shelving systems discussed above.

One aspect of the present invention involves a universal mounting hook which can engage shelf supporting structures of multiple adjustable shelving systems to support a shelf, basket or merchandise display on such systems. A store using multiple styles of adjustable shelving systems (e.g., slatwall, gridwall and pegboard) can move a shelve, basket or merchandise display from one system to another without modifying or exchanging the mounting hooks used to support the shelf, basket or display unit. Thus, the universal mounting hook of the present invention provides interchangeability between multiple shelving systems.

In a preferred embodiment, the universal mounting hook comprises a generally vertical leg and a generally horizontal leg connected to the vertical leg. The vertical leg and the horizontal leg desirably are integrally formed.

The vertical leg includes an attachment hook and an abutting member. The attachment hook is configured to engage the supporting structure of the shelving system and is distanced from the abutting member. The universal mounting hook further includes a support member which is configured to interact with the supporting structure to support the mounting hook with said attachment hook interacting with the supporting structure to limit rotation of the mounting hook about said support member.

The supporting member preferably forms a portion of a clasp configured to receive a portion of the supporting structure to support the mounting hook on the supporting structure with the attachment hook interacting with the supporting structure to prevent the mounting hook from rotating about the clasp. The clasp is positioned distal of the abutting member such that with the attachment hook supporting the overall mounting hook on the supporting structure, the abutting member interacts with the supporting structure to prevent the mounting hook from rotation about the attachment hook. As used herein, "distal" and "proximal" are in reference to proximity of the supporting structure (e.g., the wallboard, pegboard panel or gridwall panel) to which the universal mounting hook is attached.

The attachment hook is preferably positioned at the top of the vertical leg and is configured to insert into and engage with a groove of a slatwall shelving system. It is also preferred that attachment hook is sized and shaped to insert into a peg hole of a pegboard panel and engage with the pegboard panel to support the mounting hook when used with a pegboard shelving system.

The clasp is preferably configured to releasably receive a grid wire of a gridwall shelving system and the abutting member is desirably sized and positioned to pass through the grid spacing of the gridwall panel with the clasp releasably receiving the grid wire.

The clasp desirably comprises an indentation and a spring clip. The indentation interconnects the base of the vertical leg and a proximal end of the horizontal leg. The spring clip extends from the proximal end of the horizontal leg. The spring clip and the indentation form an enclosure or pocket sized to receive a portion of the shelf supporting structure.

In another preferred embodiment, the universal mounting hook comprises a generally vertical leg and a generally horizontal leg. The horizontal leg connects to the vertical leg and extends outward from the supporting structure in a cantilever fashion. The horizontal leg bears a downward force (i.e., weight) which produces a downward translational force and a rotational force on the universal mounting hook.

The universal mounting hook also comprises an attachment hook positioned at the top of the vertical leg and configured to interact with the supporting structure so as to counteract at least the rotational force. The mounting hook further includes a clasp positioned at the base of the vertical leg and configured to releasably receive a portion of the supporting structure so that the clasp engages the supporting structure to counteract both the translational and rotational forces.

In a further preferred embodiment, the universal mounting hook additionally comprises an abutting member. The abutting member is positioned from the attachment hook so as to counter the rotational force by interacting with the supporting structure, and the attachment hook is configured to engage the supporting structure so as to counteract both the translational and rotational forces.

Another aspect of the present invention involves a universal mounting hook for interchangeable use between shelving systems having dissimilar supporting structures. The mounting hooks are attached to merchandise support elements. The merchandise support elements preferably comprise merchandise shelves, straight shelves, display shelves, compartmental shelves, hardware shelves, baskets or display units. In a preferred embodiment, each universal mounting hook is configured to engage the shelf supporting structures of a slatwall shelving system, a gridwall shelving system and a pegboard shelving systems.

In accordance with a preferred method of selective attaching a shelf to a supporting structure of a slatwall shelving system, a gridwall shelving system and a pegboard shelving system, a shelf connected to a plurality of universal mounting hooks is provided and removed from the slatwall shelving system. That is, the attachment hook of the mounting hook is removed from the groove in the wallboard of the slatwall shelving system. The attachment hook is then positioned behind a first grid wire of a gridwall panel of the gridwall shelving system. To secure the shelf on the gridwall panel, the clasp is releasably engaged with a second grid wire. The clasp is preferably positioned below the attachment hook when attached to the gridwall panel.

The method may also include the step of removing the shelf from the gridwall panel and attaching it to a pegboard panel of the pegboard shelving system. The second grid wire is first released from the clasp and the attachment hook is removed from behind the first grid wire. The attachment hook is subsequently inserted into a peg hole of the pegboard panel to support the shelf on the pegboard panel. Finally, the abutting member is positioned against the pegboard panel with the mounting hook hanging from the attachment hook inserted through the peg hole.

BRIEF DESCRIPTION OF THE DRAWINGS

These and other features of the invention will now be described with reference to the drawings of a preferred embodiment of the present invention which is intended to illustrate, and not to limit the invention, and in which.

DETAILED DESCRIPTION OF THE INVENTION

Figure 1A:
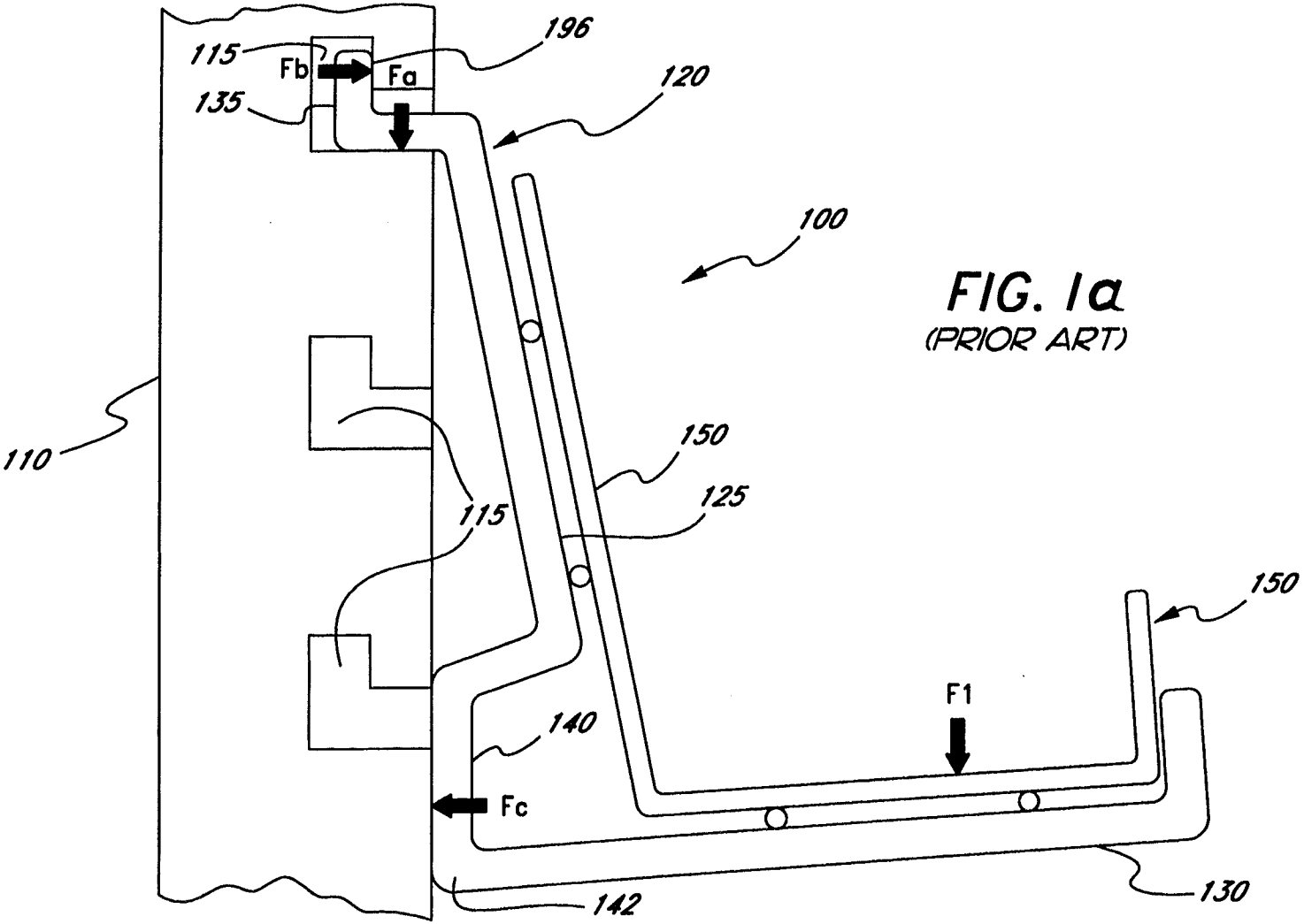
FIG. 1a (PRIOR ART)
FIG. 1*a* is a cross-sectional elevational view illustrating a mounting hook used with a slatwall shelving system.
Figure 1B:
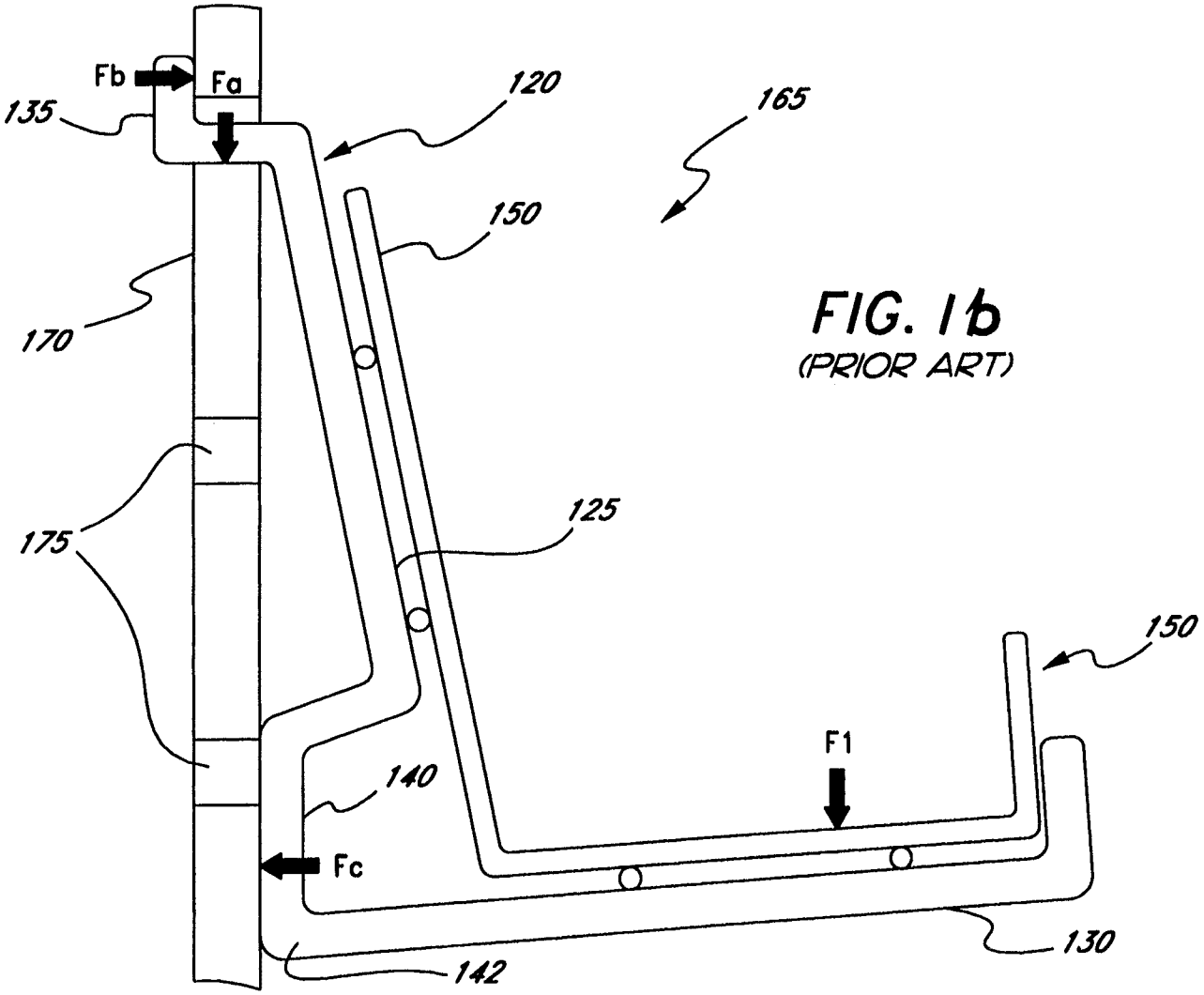
FIG. 1b (PRIOR ART)
FIG. 1*b* is a cross-sectional elevational view illustrating a mounting hook used with a pegboard shelving system.
Figure 1C:
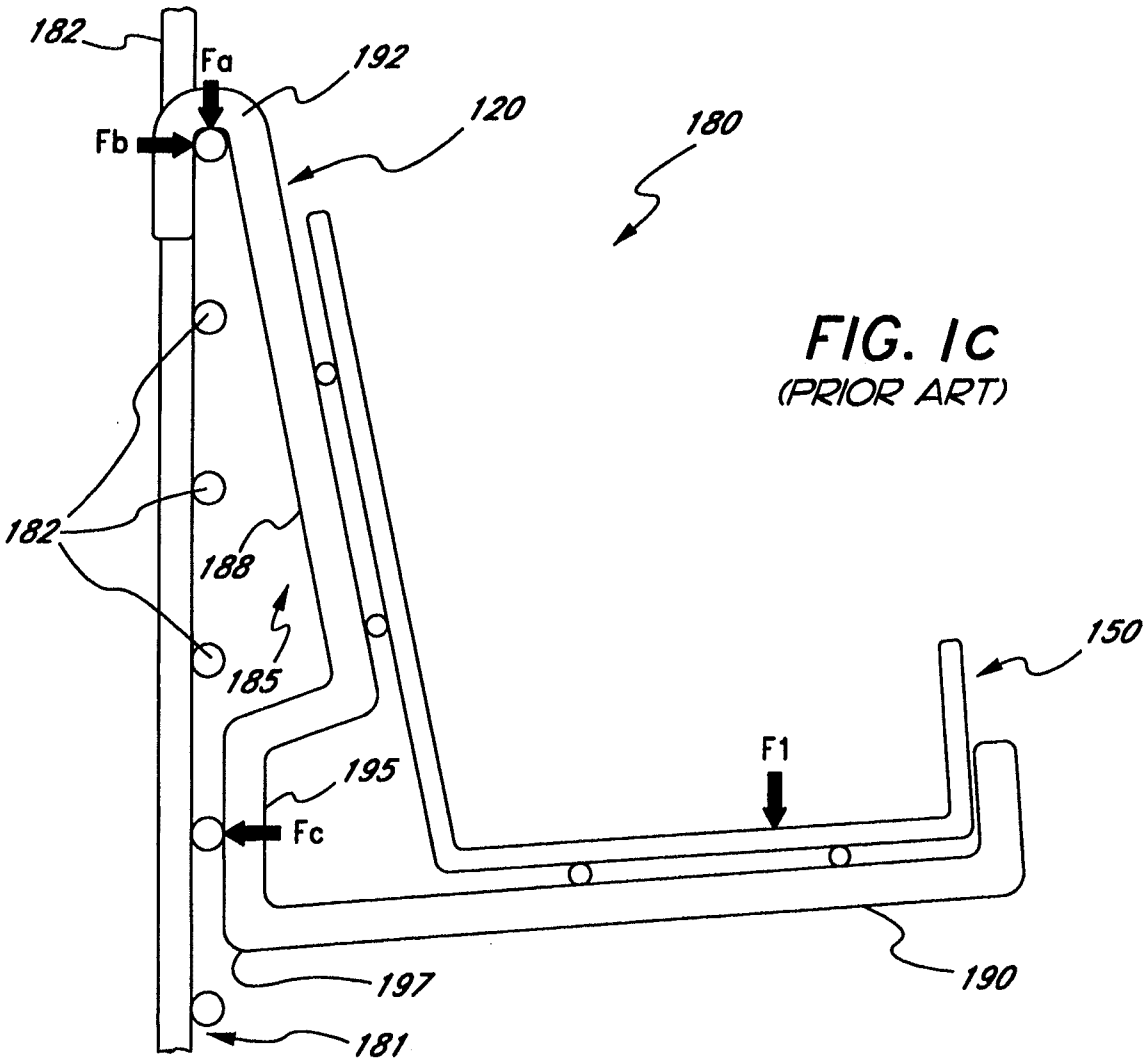
FIG. 1C (PRIOR ART)
FIG. 1*c* is a cross-sectional elevational view illustrating a mounting hook used with a gridwall shelving system.

FIGS. 1*a*–1*c* illustrate embodiments of conventional shelving systems. The basic understanding of these shelving systems is essential to an appreciation of the present invention. Although the present invention may have equal applicability to other adjustable shelving systems, FIGS. 1*a*–1*c* represent the most prevalent commercial shelving systems in use today: a slatwall shelving system, a pegboard shelving system and a gridwall shelving system, respectively.

Slatwall Shelving System

FIG. 1*a* shows a slatwall shelving system 100 comprising a slatwall panel or wallboard 110 having "L"-shaped or "T"-shaped horizontal grooves 115 formed therein. A mounting hook 120, having a generally vertical leg 125 and a generally horizontal leg 130, is secured to the panel. At the top of the vertical leg 125, an "L"- shaped hook 135 is integrally formed with the vertical leg 125. The vertical leg 125 also includes an abutting portion 140 located proximate to the base 142 of the vertical leg 125 (i.e., the junction between the vertical leg 125 and the horizontal leg 130). As illustrated in FIG. 1*a*, the abutting portion 140 may be offset from or protrude from the vertical leg 125, towards the wallboard 110.

A merchandise shelf or basket 150 rests against the mounting hook 120 so that the back of the shelf 150 is substantially contiguous with the vertical leg 125 and the bottom of the shelf 150 is substantially contiguous with the horizontal leg 130. The mounting hook 120 is typically welded to the shelf or basket 150 in this position.

As FIG. 1*a* illustrates, in order to secure the mounting hook 120 and attached shelf 150 to the panel 110, the "L"-shaped hook 135 is inserted into the "L"-shaped or "T"-shaped groove 115 of the wallboard 110. The mounting hook 120 rests against the wallboard 110 with the abutting portion 140 contiguous with the wallboard 110. When merchandise is placed onto the shelf 150, the combined weight of the merchandise and shelf 150 apply a downward load F1 acting on the horizontal leg 130 of the mounting hook 120. The cantilevered horizontal leg 130 acts as a moment arm about the base 142 of the vertical leg 125 so that the force F1 produces a moment about the base 142 of the mounting hook 120, in addition to the generally downward translational force.

FIG. 1*a* illustrates the horizontal and vertical forces Fa, Fb and Fc generated by the applied load F1. These forces Fa, Fb and Fc represent the direction in which the mounting hook 120 would naturally move in response to the applied load F1 if not restrained by the wallboard 110. The force Fa represents the general downward translational force due to the applied load F1, while the forces Fb and Fc represent the resultant rotational forces about the base 142 of the mounting hook 120 caused by the moment imparted by the applied load F1. Thus, in order for the slatwall shelving system 100 to remain stable and at rest, the interaction between the mounting hook 120 and the wallboard 110 must provide equal and opposite counteracting forces.

As seen in FIG. 1*a*, the bottom surface of the groove 115 counteracts the force Fa at the base of the "L"-shaped hook 135 so that the wallboard 110 supports the weight of the shelf and merchandise. The inside surface of the groove 115 counteracts the rotational force Fb at the tip of the "L"-shaped hook 135, while the outside surface of the wallboard 110 counteracts the rotational force Fc at the abutting portion 140. Thus, the wallboard 110 supports the mounting hook 120 and the attached shelf 150.

Pegboard Shelving System

FIG. 1*b* illustrates a conventional pegboard shelving system 165. The pegboard shelving system 165 comprises the mounting hook 120 and shelf 150 assembly having substantially the same components as the mounting hook and shelf assembly described in FIG. 1*a*. Where appropriate, like components of the described shelving systems have been designated by the like reference numerals. The pegboard shelving system 165 also includes a pegboard panel 170 having peg holes 175 formed therein.

The mounting hook 120 is secured to the pegboard panel 170 in a manner similar to that employed in the slatwall shelving system 100 (FIG. 1*a*). As illustrated in FIG. 1*b*, the "L"-shaped hook 135 is inserted into one of the peg holes 175 with the abutting portion 140 of the mounting hook 120 resting against the outside surface of the pegboard panel 170.

The pegboard panel 170 supports the mounting hook 120 in a similar manner to that described above. FIG. 1*b* also illustrates the load F1 applied to the mounting hook 120 by the weight of the shelf and merchandise, and the resulting forces Fa, Fb, Fc produced by the applied load. The pegboard panel 170 counteracts these forces in a manner similar to that described above in connection with the slatwall shelving system 100.

Gridwall Shelving System

FIG. 1*c* illustrates a conventional gridwall shelving system 180 in cross section. The gridwall shelving system 180 comprises a sturdy wire panel 181 formed by a grid of crisscrossing wires 182. In the embodiment shown in FIG. 1*c*, a plurality of horizontal and vertical wires 182 form the gridwall panel 181. The gridwall shelving system 180 further comprises a mounting hook 185 having a generally vertical leg 188 and a generally horizontal leg 190. An inverted "U"-shaped catch 192 is integrally formed at the top of the vertical leg 188. The vertical leg 188 also includes an abutting portion 195 positioned proximate to the base 197 of the vertical leg 188 (i.e., the junction between the vertical leg 188 and the horizontal leg 190). The mounting hook 185 is welded to the shelf 150 in a manner positioning the back of the shelf 150 substantially contiguous with the vertical leg 188 and positioning the bottom of the shelf 150 substantially contiguous with the horizontal leg 190.

To secure the mounting hook 185 onto the gridwall frame 181, the catch 192 is hooked over one of the wires 182 to hang the mounting hook 185 from the wire 182 with the abutting portion 195 resting against one or more of the wires 182. Thus, the abutting portion 195 must have a sufficient length (i.e., greater than the distance between adjacent wire rows) to insure that the abutting portion 195 rests against one or more of the wires 182 when attached to the gridwall panel 181.

When merchandise is placed into the basket 150, the combined weight of the merchandise and shelf 150 applies a load F1 on the horizontal leg 190 of the mounting hook 185. As with the pegboard and slatwall systems, the applied load F1 produces a downward translational force Fa as well as rotational forces Fb and Fc about the base 197 of the mounting hook 185. These forces must therefore be countered by the wires 182 in order for the system to remain at rest. As seen in FIG. 1*c*, the wire 182 about which the catch 192 curves counteracts the downward translational force Fa and prevents the mounting hook from falling downward. This wire 182 also counteracts the rotational force Fb. A lower wire 182 abutting the abutting portion 195 counteracts the rotational force Fc. Thus, the counter forces applied by the wires 182 prevent the mounting hook 185 from rotating, and hold the mounting hook 185 and shelf 150 on the gridwall panel 181.

The foregoing discussion of the conventional shelving systems makes clear that the mounting hooks used with the systems are not interchangeable. That is, the mounting hook 120 of slatwall shelving system 100 cannot be used with the gridwall shelving system 180, and vice versa. The forces required to support the shelves and merchandise are different from the gridwall shelving system to the slatwall or pegboard shelving systems, and, thus, the means previously used to attach the mounting hooks to the supporting structure of the shelving systems are not similar, and cannot be interchanged.

Specifically, the "L"-shaped hook 135 at the top of the vertical leg 125 (FIG. 1*a*) is not adapted to contact the wire 182 in such a manner as to simultaneously counter both the downward translational force Fa and the rotational force Fb. For instance, if the mounting hook 120 (FIG. 1*a*) is positioned on the gridwall panel 181 (FIG. 1*c*) so that the inside tip 196 (FIG. 1*a*) of the "L"-shaped hook 135 contacts the wire 182, then the wire 182 would only counter the rotational force Fb. The grid wire 182 would not counter the downward translational force Fa and consequently the mounting hook 120 would fall. If, on the other hand, the mounting hook 120 is positioned on the gridwall panel 181 so that the bottom of the "L"-shaped hook 135 rests on top the wire 182, then the wire 182 would only counter the downward translational force Fa and the rotational force Fb would cause the mounting hook 120 to rotate off the wire 182. Although it may be possible to sufficiently extend the length of the vertical member of the "L"-shaped hook 135 so that it would catch a wire 182 above the first wire 182 supporting the "L"-shaped hook 135, the extended vertical member of the hook 135 would preclude the hook's use with conventional slatwall shelving systems because the grooves 115 (FIG. 1*a*) could not receive such an extended "L"-shaped hook. Thus, the mounting hooks 120 of the slatwall shelving system 100 and the pegboard shelving system 165 cannot be used in gridwall shelving systems 180.

It is also understood that the mounting hook 185 of the gridwall shelving system 110 cannot be used with the slatwall or pegboard shelving systems 100, 165. The grooves 115 of the slatwall system 100 cannot receive the catch 192 of the mounting hook 185. The catch 192 also poses a problem in the case of the pegboard system 165 because inserting the catch 192 into conventionally sized peg holes may be difficult or impossible.

Thus, the mounting hook 185 of the gridwall system 180 cannot be used in conjunction with conventional slatwall wallboards 110 or conventional pegboard panels 170. Likewise, the mounting hook 120 of the slatwall and pegboard systems 100, 165 cannot be used in conjunction with conventional gridwall panels 181. Hence, there exists a need for a universal mounting hook which may be used in conjunction with conventional slatwall, pegboard, and gridwall shelving systems.

Universal Mounting Hook

Figure 2:
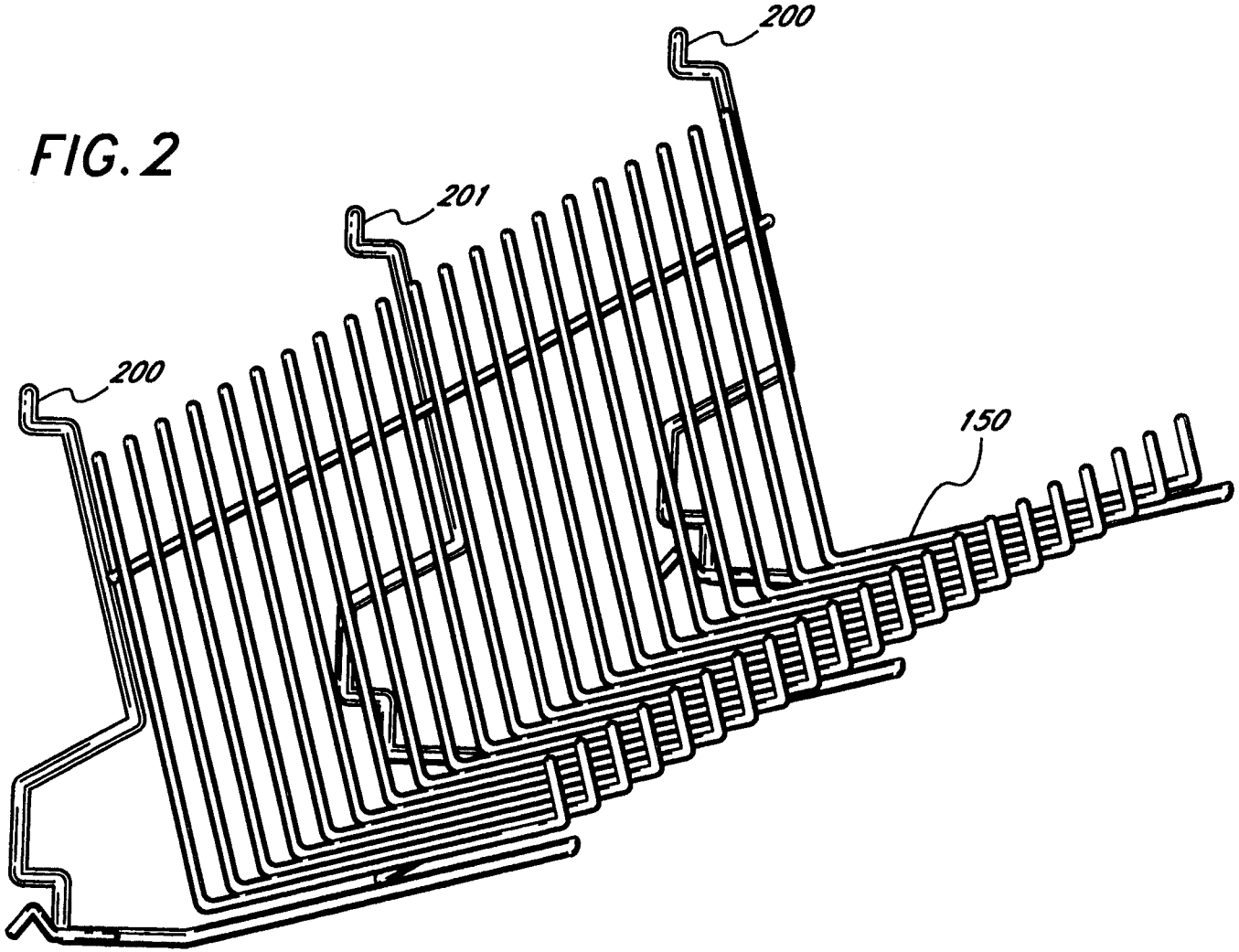
FIG. 2 is a perspective view of a straight wire shelf supported by a pair of universal mounting hooks configured in accordance with a preferred embodiment of the present invention.

FIG. 2 illustrates a pair of universal mounting hooks 200 configured in accordance with the present invention and coupled to the sides of a straight wire shelf 150. FIG. 2 also illustrates a central universal mounting hook 201 disposed between the pair of side universal mounting hooks 200. It is contemplated that the structure of the side universal mounting hooks 200 and of the central universal mounting hook 201 will be substantially identical, and the description herein of one will be understood as applying equally to both, except where specified to the contrary.

Each mounting hook 200 is configured for use with slatwall, gridwall, pegboard and like adjustable shelving systems, to mount the shelf 150 onto the shelf supporting structure (e.g., a wallboard 110 or gridwall panel 181), as discussed in detail below. Although FIG. 2 illustrates the universal mounting hook 200 in connection with a straight wire shelf 150, it is understood that the universal mounting hook 200 could be used with other types of shelves, such as, for example, display shelves, compartmental shelves, hardware shelves and the like, as well as with baskets, display units and similar merchandisers.

Figure 3A:
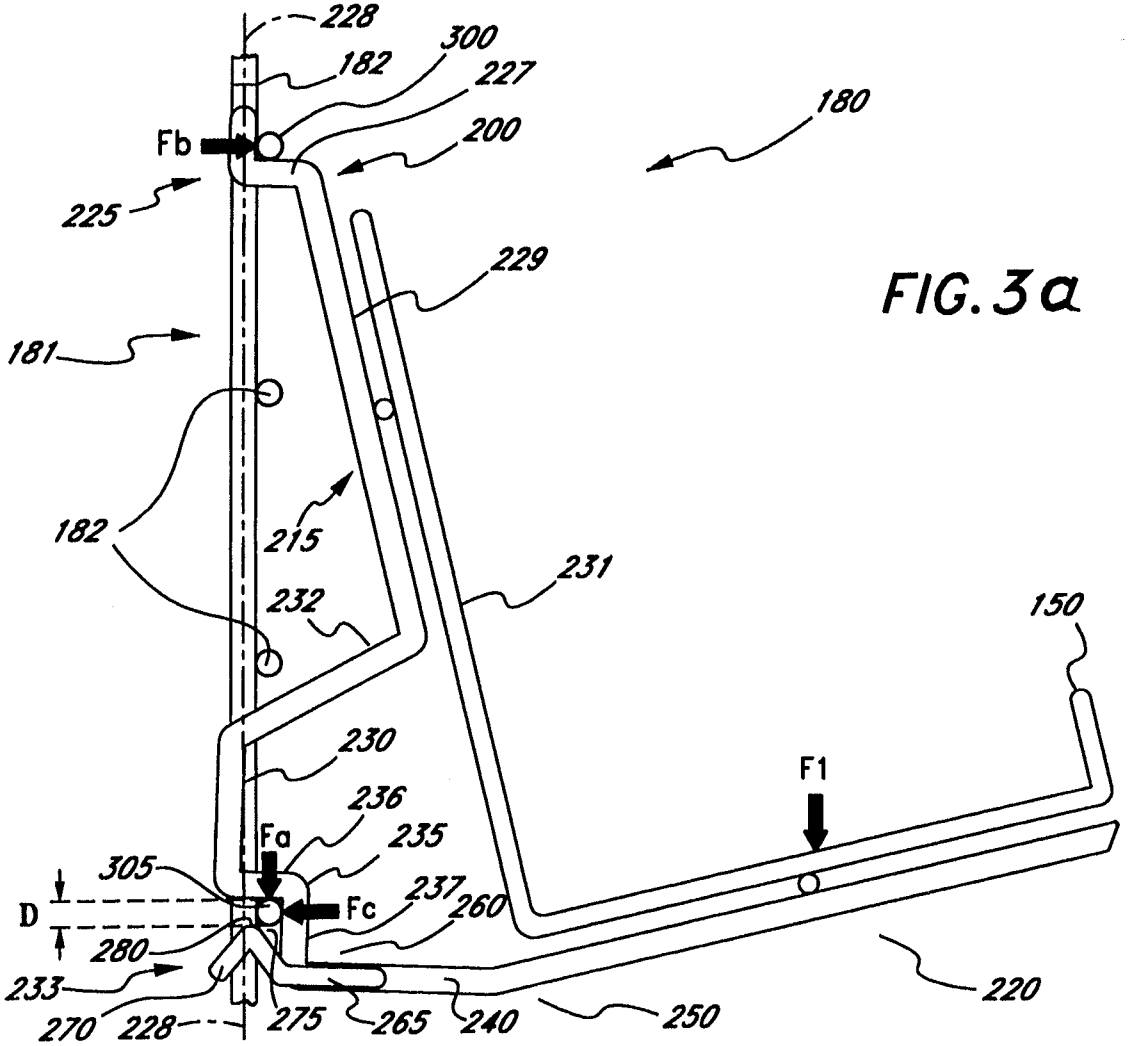
FIG. 3*a* is a cross-sectional elevational view illustrating the universal mounting hook of FIG. 2 coupled to a gridwall shelving system.
Figure 3B:
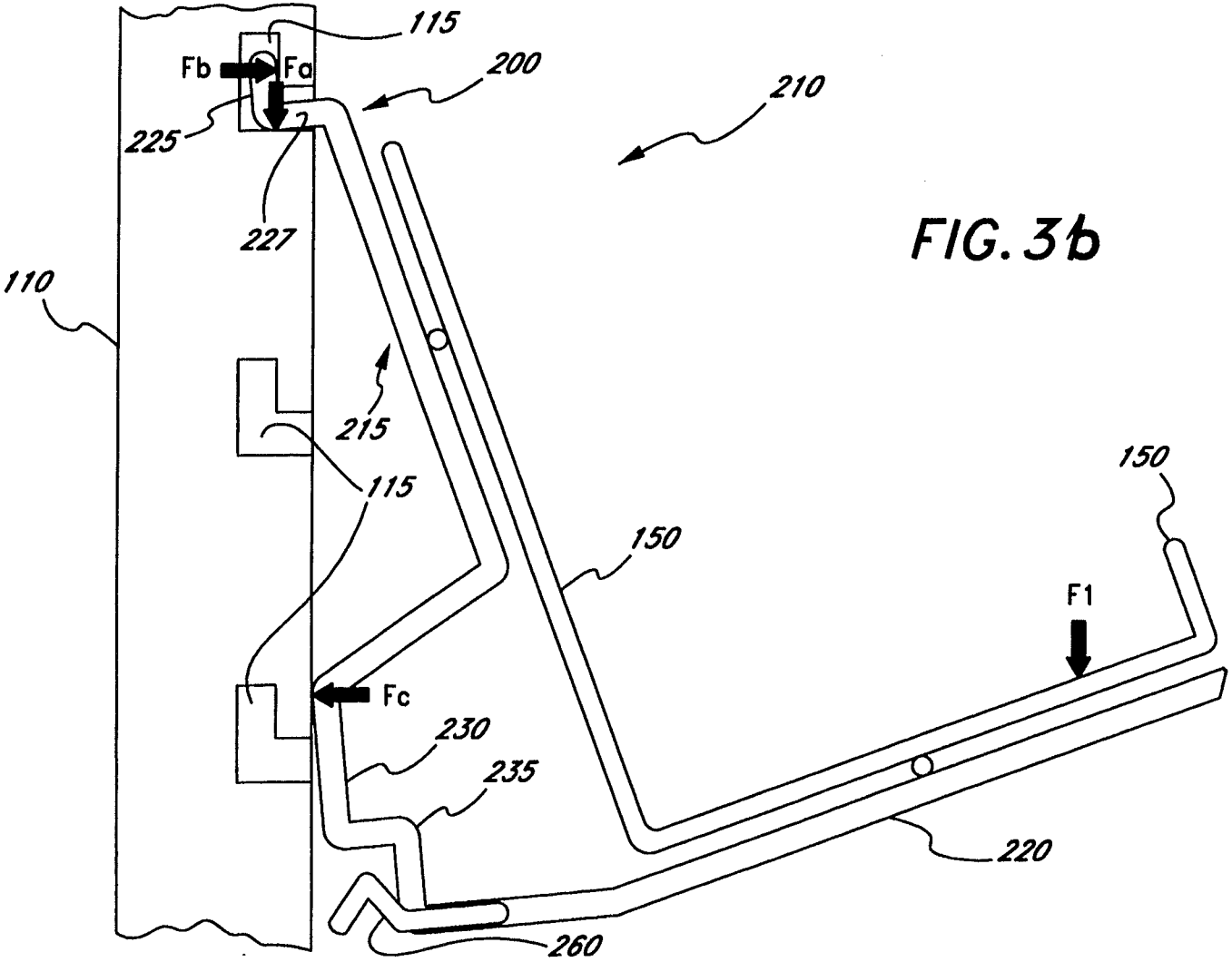
FIG. 3*b* is a cross-sectional elevational view illustrating the universal mounting hook of FIG. 2 coupled to a slatwall shelving system.
Figure 3C:
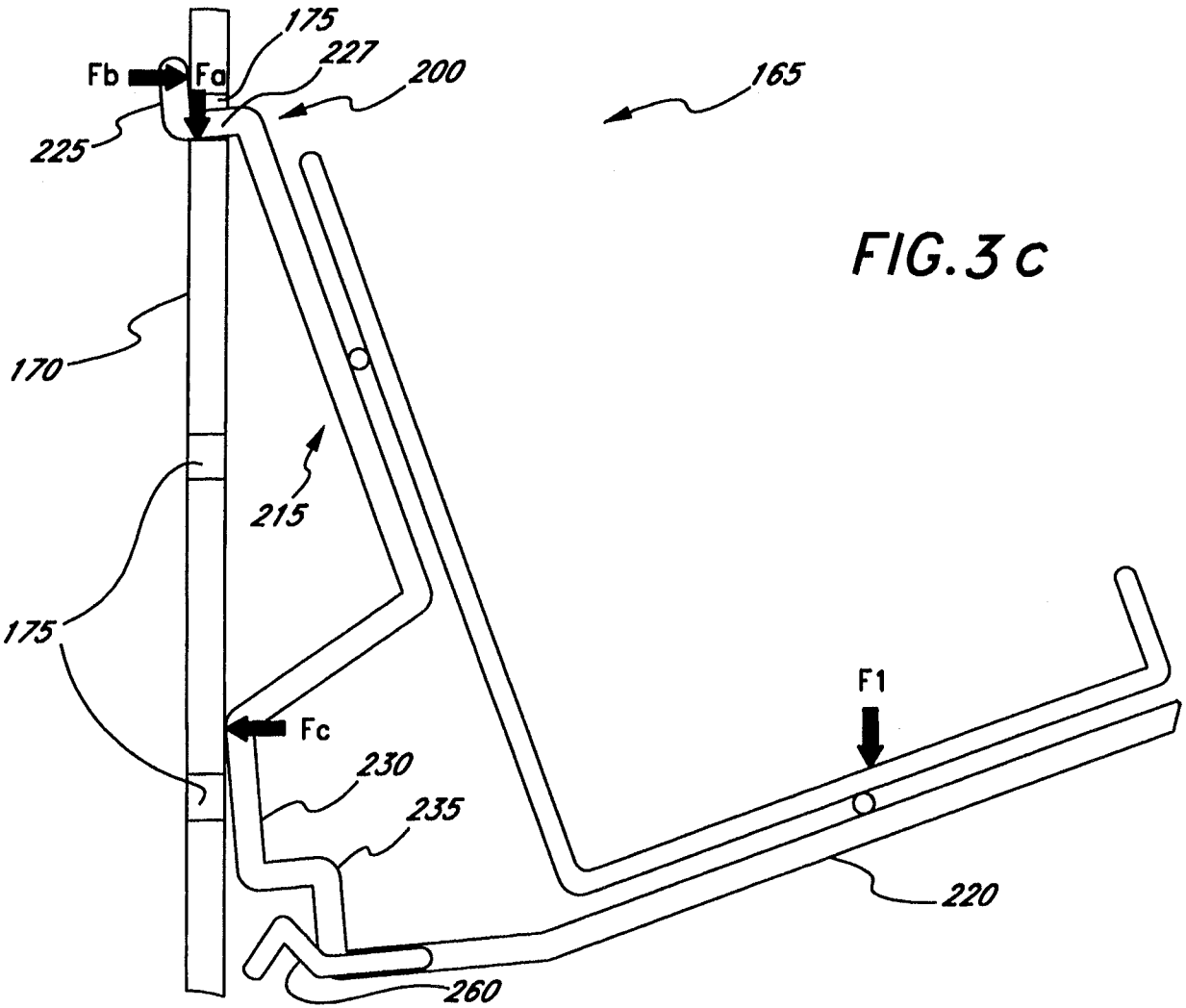
FIG. 3*c* is a cross-sectional elevational view illustrating the universal mounting hook of FIG. 2 coupled to a pegboard shelving system.

FIG. 3*a* illustrates the universal mounting hook 200 used in connection with a gridwall panel 181 of the gridwall shelving system 180. The universal mounting hook 200 has a substantially "L"-shape formed by a generally vertical leg 215 and a generally horizontal leg 220. It should be noted that, although the segments of the mounting hook 200 are referenced as discrete sections, the segments are preferably integrally formed and continuous with one another, unless described otherwise.

The vertical leg 215 comprises an attachment hook 225 desirably positioned at the top of the vertical leg 215. The attachment hook 225 generally is formed by a generally vertical anchoring member 226 and a transition member 227. The attachment hook 225 further is sized and shaped to insert into and engage with conventional slatwall grooves 115 and pegboard holes 175 and to engage with conventional grid wires 182. In a preferred embodiment, the attachment hook 225 generally has an "L"-shape, with the anchoring member 226 having a length generally of 0.5 inch (1.3 cm) and the transition member 227 having a length generally of 0.37 inch (0.95 cm). The transition member 227 is preferably positioned generally perpendicular to the anchoring member 226, which defines a vertical axis 228 of the mounting hook 200. It is understood, however, that dimensions and bend angles of the attachment hook 200 can readily be customized to suit dimensional and configuration requirements specific to a particular shelving system.

The attachment hook 225 connects to a central member 229 of the vertical leg 215 at the distal end of the transition member 227. Again, as used herein, "proximal" and "distal" are used in reference to proximity of the supporting structure (e.g., gridwall panel 181) to which the universal mounting hook 200 is attached. The central member 229 preferably has a sufficient length to distance the horizontal leg 220 from the attachment hook 225 by a length greater that the height of the rear vertical panel 231 of the shelf 150. In an exemplary embodiment, the central member 229 has a length generally of 4.06 inches (10.3 cm). The central member 229 advantageously is skewed from the vertical axis 228 such that the rear panel 231 of the shelf 150 tilts back towards the supporting structure (e.g., the grid panel 181) to prevent merchandise on the shelf 150 from accidentally falling off the shelf 150. The central member 229 is preferably oblique to the vertical axis 228 by at least 5°, and more preferably by about 15°.

The lower portion of the vertical leg 215 is formed by a lower transition member 232, an abutting member 230 and an indentation 235. The lower transition member 232 interconnects the central member 229 with the abutting member 230, and protrudes proximally away from the central member 229. As illustrated in FIG. 3*a*, the lower transition member 232 preferably angles from the vertical axis 228 and has a length selected to position the abutting member 230 between the horizontal grid wires 182 of the grid panel 181. In an exemplary embodiment, the lower transition member 232 has a length approximately equal to 1.87 inches (4.75 cm) and angles from the vertical axis 228 by about 60°.

At least a portion of the longitudinal axis of the abutting member 230 desirably is positioned co-axially with the vertical axis 228 to facilitate the proper positioning of the clasp 233, as discussed in detail below. As illustrated in FIG. 3*a*, the abutting member 230 advantageously has a length less that the spacing between the horizontal wires 182 of the grid panel 181 to allow the abutting member 230 to pass between the grid wire 182 when used with a gridwall shelving system 180. In an exemplary embodiment, the abutting member 230 has a length of about 1.5 inches (3.8 cm) for use with grid panel 181 having greater than a 2.0-inch (5.1-cm) on center grid pattern.

The indentation 235 interconnects the base of the abutting portion 230 with the proximal end of the horizontal leg 220. The indentation 235 generally is formed by a support member 236 and a bottom transition member 237, and is sized and shaped to receive a wire 182 of the grid panel 181. In a preferred embodiment, the indentation 235 generally has an inverted "L"-shape, with the support member 236 having a length generally of 0.44 inch (1.1 cm) and the bottom transition member 237 having a length generally of 0.5 inch (1.3 cm). The support member 236 is preferably positioned generally perpendicular to the abutting member 230 and to the bottom transition member 237. Again, it is understood that those skilled in the art could readily customize the dimensions and bend angles of the mounting hook 200 to suit dimensional and configuration requirements specific to a particular shelving system.

As illustrated in FIG. 3*a*, the horizontal leg 220 extends distally from the base of the indentation 235, and is formed by a proximal member 240 and a distal member 245. The proximal member 240 preferably extends perpendicular to the bottom transition member 237 of the indentation 235 for a length desirably greater than the length of the lower transition member 232 of the vertical leg 215. As FIG. 3*a* illustrates, the length of the proximal member 240 more preferably extends to a junction 250 with lies substantially collinear with the longitudinal axis of the central member 229 of the vertical leg 215.

The distal member 245 extends from the junction 250 in the distal direction for a length sufficient to support the bottom panel 255 of the shelf 150, but preferably does not extend beyond the shelf bottom panel 255. In an exemplary embodiment, the distal member 245 has a length generally of 6.13 inches (16.5 cm). The distal member 245 also is skewed upwardly from the horizontal proximal member 240 in order to tilt the shelf bottom panel 255 in the proximal direction. In this manner, merchandise supported by the shelf cannot easily or accidentally fall off the shelf 150. The distal member 245 preferably forms at least a 5° angle with a horizontal axis defined by the proximal member 240, and more preferably forms a 15° angle with the horizontal axis.

FIG. 3*a* further illustrates that the universal mounting hook 200 includes the clasp 233 configured to engage a portion of the shelf supporting structure for use in some applications, and positioned non-functionally (i.e., in a unobtrusive position) for use in other applications. For instance, when the universal mounting hook 200 is used with a gridwall shelving system 180, the clasp 233 releasably receives in a snap fit fashion a horizontal wire 182 of the grid panel 181; when the universal mounting hook 200 is used with a slatwall shelving system 100, the clasp 233 is positioned distally of the abutting section 230 which abuts the wallboard 110, as discussed in detail below. The central mounting hook 201, however, desirably does not include a clasp 233.

In the embodiment illustrated in FIG. 3*a*, the clasp 233 is formed by the indentation 235 of the vertical leg 215 and a spring clip 260 (i.e., a leaf spring) attached to the proximal member 240 of the horizontal leg 220. The clasp 233 is preferably positioned directly below the attachment hook 224 such that the clasp 233 and the attachment hook are substantially collinear.

The spring clip 260 in the illustrated embodiment comprises a straight attachment section 265 and a crimp 270. The attachment section 265 is rigidly attached to the horizontal leg 220 by welding, brazing, affixing by an adhesive, or other means known in the art. Alternatively, the spring clip 260 could be integrally formed with the horizontal leg 220. The attachment section 265 in the illustrated embodiment is positioned to lie generally parallel to the proximal member 240 of the horizontal leg 220, and is further positioned such that the spring clip 260 extends proximally to a point proximate to the vertical axis 228.

The crimp 270 is positioned on the proximal end of the spring clip 260 and preferably has an inverted "V"-shape. The crimp 270 and the indentation 235 of the vertical leg 215 form an enclosure or pocket 275 having a sufficient size to receive a portion of the supporting structure. For use with a gridwall shelving system 180, as illustrated in FIG. 3*a*, the pocket 275 is preferably sized to receive the diameter of a horizontal grid wire 182. In an exemplary embodiment, the pocket 275 is sized to receive a 0.25 inch (0.63 cm) diameter wire 182.

It is also preferred that the clasp 233 receives the wire 182 in a snap fit fashion. That is, a distance D between the support member 236 of the indentation 235 and an apex 280 of the crimp 270 is normally less than the diameter of the grid wire 182. In an exemplary embodiment, the distance D approximately equals 0.19 inch (0.48 cm) for use with a grid wire 182 having a diameter of 0.25 inch (0.63 cm).

It is contemplated, however, that the spring clip 260 could be omitted or that the clasp 233 could take other forms so long as the clasp 233 is configured to engage a portion of the supporting structure (e.g., the gridwall panel 181). It is understood that the clasp 233 could simply comprise the support member 236 which would rest upon a grid wire 182 or like structural support of the shelving system to support the shelf 150. In a more preferred embodiment, the clasp 233 could also include a retainer to secure the support member 236 on the grid wire 182. Although FIG. 3*a* illustrates the retainer as the spring clip 260, it is contemplated that the retainer could comprise a protuberance or an extension of the abutting member 230 which extends below the support member 236, or could comprise a notch formed on the support member 236 which cooperates with the grid wire 182.

The merchandise shelf or basket 150 may be permanently attached to the universal mounting hook 200 by welding or like means as the mounting hook is interchangeable between shelving systems. That is, because there is no need to substitute different styles of mounting hooks in order to move the shelf from one type of shelving system (e.g., slatwall) to another type of shelving system (e.g., gridwall), the shelf can be permanently attached and still be used with all shelving systems.

The mounting hook 200 is preferably made from a lightweight and sturdy material such as, for example, aluminum or steel, or from a durable plastic, such as, for example, polycarbonate. It should be noted, however, that other materials could comprise the mounting hook 200, depending upon the specific application.

The vertical and horizontal legs 215, 220 of the mounting hook 200 are preferably integrally formed from a generally constant diameter wire bent into the mounting hook shape described above. In an exemplary embodiment, the diameter of wire generally equals 0.19 inch (0.48 cm). However, as will be appreciated by those skilled in the art, mounting hooks incorporating the present invention can be manufactured in any of a wide variety of sizes in addition to those described herein.

Method of Using Universal Mounting Hooks With Conventional Shelving Systems

FIGS. *3a*, *3b* and *3c* illustrate the unique advantage of the universal mounting hook 200 over prior mounting hooks by depicting the use of the universal mounting hook in conjunction with a gridwall shelving system 180, a slatwall shelving system 100, and a pegboard shelving system 165, respectively. The following discussion describes the universal mounting hook 200 used in connect with each of these common shelving systems. It is contemplated, however, that the present mounting hook could be adapted in accordance with the present invention for use with other shelving systems.

FIG. *3a* illustrates the universal mounting hook 200 coupled to a grid panel 181 of the gridwall shelving system 180 to support the shelf 150 on the grid panel 181. The "L"-shaped attachment hook 225 is slipped behind a first horizontal grid wires 300 so that the inside corner of the hook 225 contacts the wire 300. A second horizontal grid wire 305 is releasably snapped into place between the spring clip 260 and the indentation 235, desirably below the first grid wire 300. That is, the second grid wire 305 deflects the spring clip 260 downward to widen the dimension D defining the opening to the clasp 233 as the grid wire 305 is slipped into the clasp 233. Once the second grid wire 305 is inserted into the pocket 275 of the clasp 233, the spring clip 260 springs back to its undeflected state to secure the grid wire 305 in place. The inverted "V"-shape of the crimp 270 aids in the deflection of the spring clip 260 when engaging and disengaging the clasp 233 from the grid wire 305. The abutting portion 230 of the universal mounting hook 200 passes between adjacent horizontal grid wires 182 with the clasp 233 snapped over the second grid wire 305.

As FIG. *3a* illustrates, the combined weight of the shelf 150 and merchandise applies a downward load F1 on the horizontal leg 220 of the mounting hook 200. The load F1 produces a downward translational force Fa as well as a moment about the second grid wire 305 grasped by the clasp 233. The moment in turn produces a rotational force Fb acting tangentially to a moment arm defined between the second grid wire 305 and the first grid wire 300. In addition, the slope of the shelf 150 in the downward, proximal direction produces a force component Fc acting in the proximal direction against the second grid wire 305. In order to stably support the shelf 150, the mounting hook 200 must engage and cooperate with the grid wires 300, 305 to counter the translational and rotational forces produced by the combined weight of the shelf and supported merchandise.

As shown in FIG. *3a*, the first grid wire 300 contacting the inside corner of the attachment hook 225 counteracts the rotational force Fb to prevent the mounting hook 200 and, thus, the shelf 150, from rotating about the second grid wire 305. Likewise, the second grid wire 305 counteracts the horizontal translational force Fc to prevent mounting hook 200 and shelf 150 from moving in the proximal direction. The support member 236 of the vertical leg 215, which rests on the second horizontal grid wire 305, counteracts the downward translational force Fa to support the mounting hook 200 and the shelf 150 on the grid panel 181. Merchandise may therefore safely and securely be positioned on the shelf 150.

FIG. *3b* illustrates the universal mounting hook 200 coupled to a wallboard 110 of the slatwall shelving system 100 to support the shelf 150 on the wallboard 110. The attachment hook 225 is inserted into one of the grooves 115 of the wallboard 110, in the conventional manner described above, in order to secure the universal mounting hook 200 to the wallboard 110. The universal mounting hook 200 hangs from the attachment hook 225 adjacent to the wallboard 110 with the abutting section 230 generally contiguous with the wallboard 110. As illustrated in FIG. *3b*, because the spring clip 260 does not extend substantially beyond the proximal edge of the abutting portion 230, the spring clip 240 does not contact the wallboard 110. In this manner, only the smooth edge of the abutting section 230 contacts the wallboard 110, thereby preventing the spring clip 260 from scratching the wallboard 110.

As FIG. *3b* further illustrates, the combined weight of the shelf 150 and merchandise applies a downward force F1 on the horizontal leg 220 of the mounting hook 200. The force F1 produces a downward translational force Fa as well as a moment about the center of gravity of the mounting hook and shelf assembly. The moment results in tangential forces Fb and Fc acting against the wallboard 110. In addition, the slope of the shelf 150 in the downward, proximal direction increases the force Fc acting in the proximal direction against the wallboard 110 at the abutting section 230. In order to stably support the shelf 150, the mounting hook 200 must engage the wallboard 110 to counter the translational and rotational forces produced by the combined weight of the shelf 150 and merchandise.

The bottom surface of the groove 115 contacting the transition member 227 of the attachment hook 225 counteracts the force Fa such that the wallboard 110 supports the weight of the shelf 150 and merchandise. The inside surface of the groove 115 counteracts the tangential force Fb at the tip of the attachment hook 225, while the outside surface of the wallboard 110 counteracts the translational force Fc at the abutting section 230. Thus, the universal mounting hook 200 coupled to the wallboard 110 stably supports the shelf 150. In this fashion, merchandise of considerable weight may be supported and displayed by means of the slatwall shelving system 100.

Referring to FIG. *3c*, a similar account can be given of the pegboard shelving system 165 wherein the universal mounting hook 200 is secured to the pegboard panel 170 by means of the peg holes 175. The attachment hook 225 is inserted into one of the peg holes 175, and the abutting portion 230 rests against the pegboard panel 170 without interference from the spring clip 240.

The mounting hook 200 thus supports the attached shelf 150 on the pegboard panel 170 in a manner similar to that described above in connection with the wallboard 110 of a slatwall system 100. Consequently, the pegboard panel 170 counteracts the translational and rotational forces applied by the weight of the shelf 150 and supported merchandise in a manner similar to that described above in connection with the slatwall system 100.

From the foregoing description of the use of the universal mounting hook 200 in connection with common adjustable shelving systems, it is apparent that the universal mounting hook 200 is readily employed with each shelving system. That is, the universal mounting hook 200 is interchangeable between slatwall, pegboard and gridwall systems. In use with each shelving system, the structure of the universal mounting hook 200 engages the supporting structure to simultaneously counter both the translational downward force and the rotational forces; prior mounting hooks could not counter such resultant forces present in each shelving system and, thus, prior mounting hooks are limited (i.e., dedicated) to a particular shelving systems. The ability to counter such resultant forces in each shelving system enables the universal mounting hook 200 to be readily used with multiple adjustable shelving systems.

Although this invention has been described in terms of a certain preferred embodiment, other embodiments that will be apparent to those of ordinary skill in the art are also within the scope of this invention. Accordingly, the scope of the invention is intended to be defined only by the claims which follow.

What is claimed is:

1. A universal mounting hook for interchangeable use between gridwall, pegboard, and slatwall shelving systems, wherein the gridwall shelving system comprises a wire grid panel, the pegboard shelving system comprises a panel having a plurality of apertures which extend between a front surface and an inner surface, and the slatwall shelving system comprises a board having a front surface and a plurality of generally parallel grooves, each groove including a first section which extends within the board and defines an inner surface which is generally parallel to the front surface, and a second section which extends generally perpendicular to the front surface, between the front surface and the first section of the groove, said mounting hook comprising:

a generally vertical leg comprising an attachment hook and an abutting member coupled together and spaced apart by a generally vertical member, said attachment hook having a first member attached to and extending between said vertical member and a second member, said first and second members configured to insert both through an aperture of the pegboard panel and into a groove of the slatwall board such that said second member engages the corresponding inner surface of the pegboard panel or the slatwall board;

a generally horizontal leg connected to said vertical leg; and a clasp being connected to said vertical leg and defining a hollow sized to releasably receive a wire of the wire grid, said clasp further comprising a flexible opening which opens into said hollow, said opening having a size generally smaller than the diameter of the wire so as to retain the wire within said hollow.

2. The universal mounting hook as defined in claim 1, wherein said vertical leg and said horizontal leg are integrally formed.

3. The universal mounting hook as defined in claim 1, wherein said hollow extends into an indentation formed in said vertical leg.

4. The universal mounting hook as defined in claim 1, wherein said first and second members of said attachment hook are positioned generally perpendicular to each other to generally form an "L" shape.

5. The universal mounting hook as defined in claim 1, wherein said attachment hook is positioned at an upper end of said vertical leg.

6. The universal mounting hook as defined in claim 1, wherein said clasp comprises an indentation and a spring clip.

7. The universal mounting hook as defined in claim 6, wherein: said indentation is disposed at an interconnection of a base of said vertical leg and a base of said horizontal leg, and said spring clip extends from said base of said horizontal leg, said spring clip and said indentation forming said hollow.

8. The universal mounting hook as defined in claim 7, wherein said spring clip is bent to releasably receive the wire of the wire grid panel in a snap fit fashion.

9. The universal mounting hook as defined in claim, 1, wherein said clasp is positioned below said attachment hook at a position which generally coincides with an axis defined by said second member of said attachment hook.

10. The universal mounting hook as defined in claim 1, wherein said clasp is positioned on said vertical leg.

11. The universal mounting hook as defined in claim 1, wherein said abutting member is sized and positioned to pass between adjacent wires of the wire grid panel with said clasp releasably engaging said wire gird panel.

12. A shelving system, comprising:

a plurality of universal mounting hooks as defined in claim 1; and a merchandise support element.

13. The shelving system of claim 12, wherein said merchandise support element is selected from the group consisting of a straight shelf, display shelf, compartment shelf, hardware shelf, basket, display unit and merchandiser.

14. A method for selectively attaching a shelf to a supporting structure of a slatwall shelving system, gridwall shelving system or a pegboard shelving system, comprising the steps of:

providing a shelf connected to a plurality of universal mounting hooks, each mounting hook comprising a generally horizontal leg connected to a generally vertical leg, the vertical leg including an attachment hook configured to attach to a support structure selected from a group consisting of a slatwall wallboard, a wire grid panel, and a pegboard panel, and a clasp configured to engage a wire of the wire grid panel:

removing said attachment hook from a groove in the wallboard of the slatwall shelving system;

positioning said attachment hook behind a first wire of the wire grid panel of the gridwall shelving system; and releasably engaging said clasp with a second wire to support said shelf on wire grid panel.

15. The method of claim 14, additionally including the step of positioning the clasp below the attachment hook.

16. The method of claim 14, additionally comprising the steps of:

releasing said second grid wire from said clasp;

removing said attachment hook from behind said first grid wire;

inserting said attachment hook into a peg hole in a pegboard panel of the pegboard shelving system to support said shelf on said pegboard panel; and abutting said abutting member against said pegboard panel.

* * * * *